US006192648B1

(12) United States Patent
Chevalier

(10) Patent No.: US 6,192,648 B1
(45) Date of Patent: Feb. 27, 2001

(54) METHOD OF INSTALLING SHIPS CABIN WALL PANELS AND A SUPPORT FOR USE IN THE METHOD

(75) Inventor: Jean-Claude Chevalier, Sainte Anne sur Brivet (FR)

(73) Assignee: Alstom France S.A., Paris (FR)

( * ) Notice: Subject to any disclaimer, the term of this patent is extended or adjusted under 35 U.S.C. 154(b) by 0 days.

(21) Appl. No.: 09/398,758

(22) Filed: Sep. 17, 1999

(30) Foreign Application Priority Data

Sep. 18, 1998 (FR) ..... 98 11661

(51) Int. Cl.[7] ..... E04B 1/00
(52) U.S. Cl. ..... 52/741.1; 52/745.09
(58) Field of Search ..... 52/741.1, 745.09, 52/745.1, 745.12, 282.1, 284, 272

(56) References Cited

U.S. PATENT DOCUMENTS

| | | | | |
|---|---|---|---|---|
| 1,603,895 | * | 10/1926 | Berger | 52/745.09 X |
| 3,690,086 | * | 9/1972 | Cole et al. | 52/745.09 X |
| 4,314,430 | * | 2/1982 | Farrington | 52/745.09 X |
| 4,506,428 | * | 3/1985 | Gerhard | 52/745.1 X |
| 4,841,710 | * | 6/1989 | Considine | 52/745.09 |
| 5,335,472 | * | 8/1994 | Phillips | 52/745.1 X |
| 5,394,665 | * | 3/1995 | Johnson | 52/745.09 X |
| 5,722,198 | * | 3/1998 | Bader | 52/745.09 |
| 6,044,614 | * | 4/2000 | Bryant | 52/745.12 |

FOREIGN PATENT DOCUMENTS

| | | | | |
|---|---|---|---|---|
| 4314422A1 | | 11/1994 | (DE) . | |
| 96199 | * | 5/1972 | (FR) | 52/745.1 |
| WO 86/06341 | | 11/1986 | (WO) . | |
| WO 86/07026 | | 12/1986 | (WO) . | |

* cited by examiner

*Primary Examiner*—Jose V. Chen
(74) *Attorney, Agent, or Firm*—Sughrue, Mion, Zinn, Macpeak & Seas, PLLC

(57) ABSTRACT

The method consists in using supports to support temporarily top rails in which the wall panels are inserted. When a few panels have been installed and fixed to the top rails, starting from a sanitation unit, the support is removed by pivoting its studs about pivots to enable installation of the wall panels to continue.

3 Claims, 6 Drawing Sheets

METHOD OF INSTALLING SHIPS CABIN WALL PANELS AND A SUPPORT FOR USE IN THE METHOD

The present invention concerns a method of installing ships' cabin wall panels.

BACKGROUND OF THE INVENTION

One prior art method for installing cabin wall panels consists in fixing a U-shaped channel bottom rails to the deck, inserting the bottom edges of the wall panels into these rails and then capping the top edges of the wall panels with an inverted U-shaped channel top rails bearing on the top edges of the panels.

The top rails have a simple inverted U-shaped channel and form a support structure for a ceiling made up of juxtaposed slats.

In the above installation method, the ceiling slats are installed last because they are fixed to the top rails which in turn rest on the vertical wall panels.

This order of installation, whereby the wall panels are installed before the ceiling and its support structure, i.e. the top rails, is open to improvement. The wall panels have already been decorated when they are installed and might therefore be damaged or soiled when fitting the ceiling slats and also the trunking, pipes, and cables which run above the ceiling and which are installed before the ceiling is completed. Also, replacing a wall panel necessitates major dismantling of ceiling slats and top rails.

Another method that is used consists in first fixing the U-shaped channel bottom rails to the deck, as previously, and then pre-installing the inverted U-shaped channel top rails by suspending them on metal suspension members from the deck above. The wall panels are then inserted into the top rails and allowed to drop into the bottom rails, sufficient distance being provided between the top and bottom rails when pre-installing the top rails that are suspended by said metal suspension members.

That method has the important advantage of the wall panels being installed last, when there is no longer any risk of them being damaged by handling other materials in their surroundings.

In particular, all trunking and cables are installed above the ceiling and the ceiling slats are installed beforehand, which is possible because they are fixed to the top rails which are pre-installed by being suspended on the metal suspension members from the deck above.

Another advantage is that it is easy to dismantle a panel because its top rail is not resting on it and so it can be disengaged from the rail to dismantle it in the same way as it was inserted in the rail when it was installed.

On the other hand, pre-installing the top rails is time-consuming and the suspension members require many welds; the suspension members also have the drawback of constituting sound conducting bridges and connections to the cabins which transmit strains in the ship's structure to the cabins.

OBJECTS AND SUMMARY OF THE INVENTION

The aim of the present invention is to propose a method of installing ships' cabin walls having the advantages of the above installation method but none of its disadvantages, i.e. a method which eliminates the suspension members for the top rails but which allows the panels to be installed by inserting them into the rails after the ceiling slats have been installed.

The invention therefore consists in a method of installing wall panels of ships' cabins including a sanitation space consisting of a sanitation unit, said wall panels being placed between a bottom rail with a U-shape section in which the panels rest and a top rail having an inverted U-shaped channel which caps the upper edges of said panels without resting on said upper edges, in which method a first step is to install the sanitation unit and then to fix to the outside periphery of the sanitation unit an angle-iron for supporting slats for making up the cabin ceiling, said bottom rails being fixed to the deck at the location of the wall panels to be installed, wherein the top rails are temporarily supported at each end by a support positioned in a corresponding bottom rail in the case of top rails which do not have one end in contact with said sanitation unit or temporarily supported by a support at one end only in the case of top rails which have one end in contact with said sanitation unit, in which case said end in contact with said unit is fixed to said angle-iron for supporting the slats, and wherein said panels are installed, starting from the sanitation unit, by inserting them in the top rail and allowing them to drop into the bottom rail, after which they are screwed to a vertical flange of the top rail, said supports being removed and replaced by wall panels as installation proceeds, the depth of the channel formed by the top rail being greater than that formed by the bottom rail.

In another feature of the invention, said slats for making up the ceiling are placed on and fixed to a top rail at each end or placed on and fixed to a top rail at one end and placed on and fixed to one of said angle-irons fixed to said sanitation unit at the other end.

The invention also consists in a support that can be dismantled for implementing the method of the invention. The support comprises two parallel simple studs connected to each other by a connecting plate extending over less than the total height of the studs and of length shorter than that of the studs by an amount not less than the depth P of the channel formed by the bottom rail, the section of said studs being such that they can be engaged in said top and bottom rails, and the connection of each stud to said connecting plate includes a pivot in a plane parallel to the plate enabling the support to be removed from its location between the top and bottom rails and replaced by a wall panel.

BRIEF DESCRIPTION OF THE DRAWINGS

An embodiment of the invention is described below with reference to the accompanying drawings, in which.

MORE DETAILED DESCRIPTION

Figure 1:
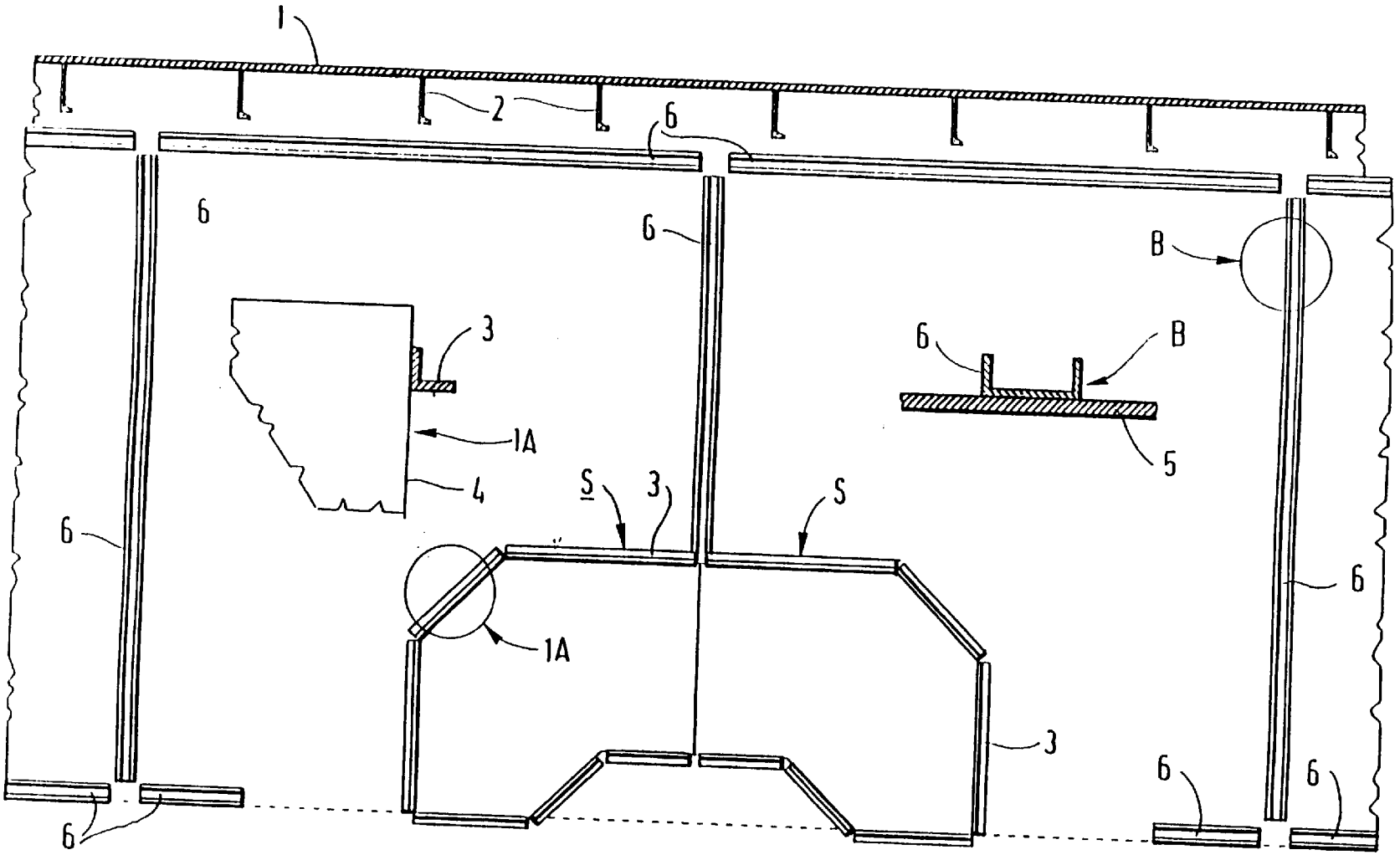
FIG. 1 is a plan view showing the location of the walls and the sanitation unit of two consecutive cabins.

FIG. 1 shows a sheet metal wall 1 with stiffeners 2. This plan view shows the location of two consecutive cabins. To install the wall panels, the first step is to install the prefabricated sanitation units S to which are fixed angle-irons 3 which support the slats making up the ceiling. An angle iron 3 is shown in section in the detail view 1A. The angle iron 3 is therefore fixed to the shell 4 of the sanitation unit at the appropriate height. Bottom rails 6 are then fixed to the deck 5 and have a inverted U-shaped channel shown in the detail B. The bottom rails 6 are fixed to the deck where the wall panels are to be installed.

Figure 2:
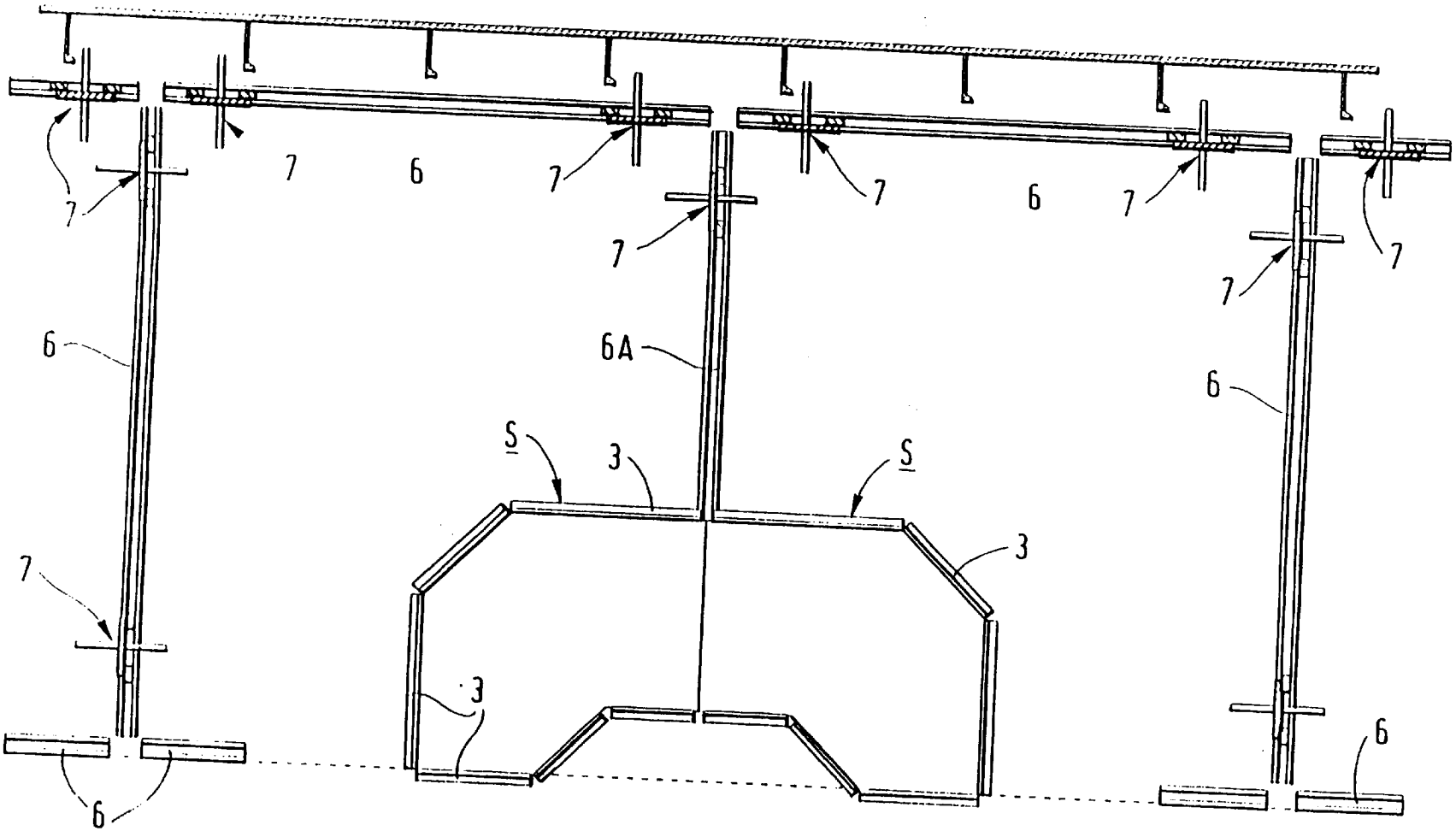
FIG. 2 shows the positioning of the supports for the top rails.
Figure 3:
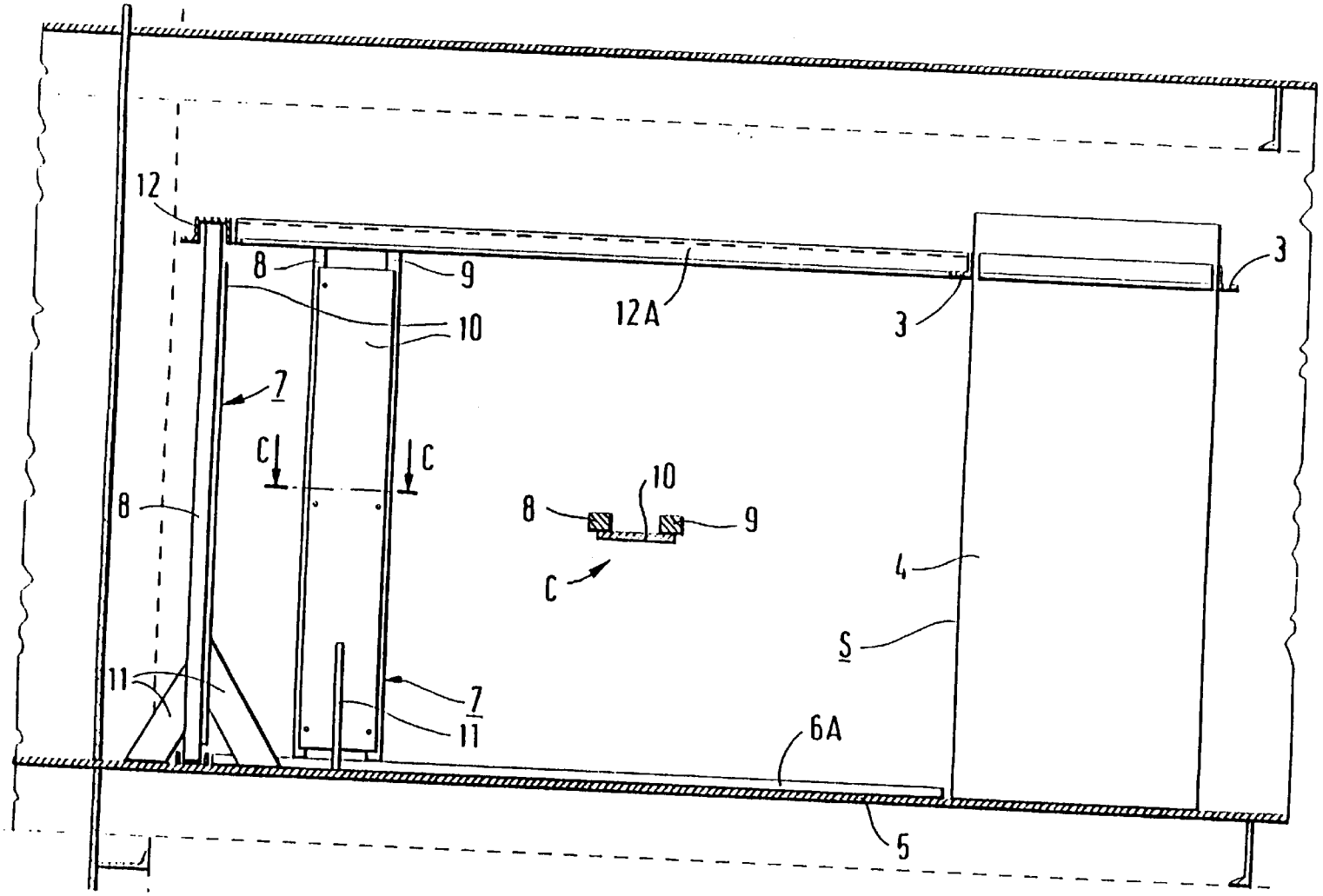
FIG. 3 is an elevation view showing the installation of a top rail.
Figure 4:
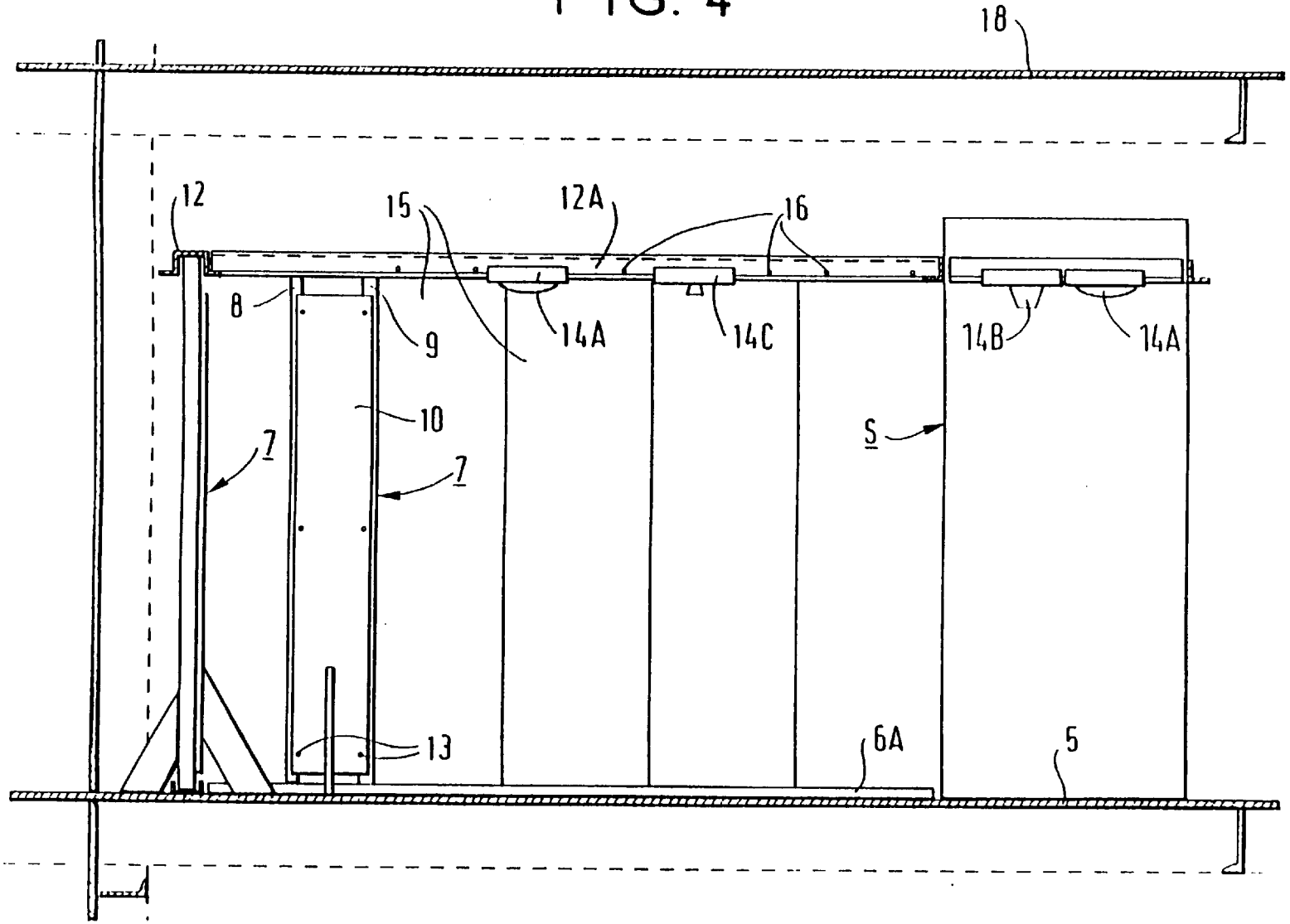
FIG. 4 shows the installation of the wall panels.

A support 7 is then placed at each end of each bottom rail 6 that is not in contact with the sanitation unit (see FIG. 2). In the case of bottom rails like the bottom rail 6A which have one end against the sanitation unit, a support 7 is placed only at its other end. FIG. 3 shows one support 7 in profile and the other from the front. The function of the supports is to support the top rails temporarily.

Figure 5:
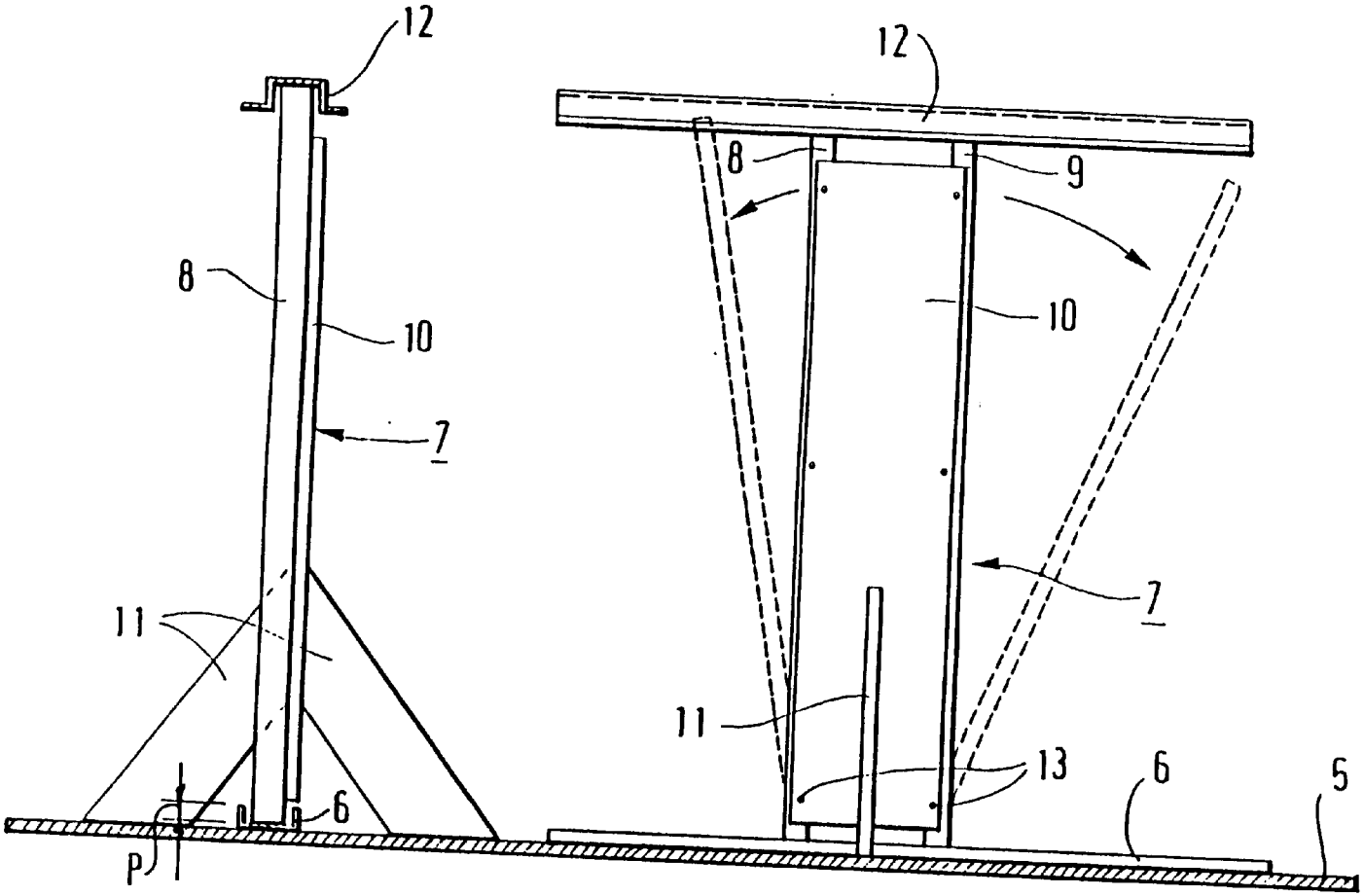
FIG. 5 shows a support being dismantled.

As shown in FIGS. 3 and 5, a support 7 is made up of two simple parallel studs 8 and 9 which are connected to each other by a connecting plate 10 which does not extend the full height of the studs 8 and 9. Its length is less than the height of the studs by an amount at least equal to the depth P of the channel formed by the bottom rail 6 (see FIG. 5). The detail C in FIG. 3 shows the support 7 in section taken along the line C—C. The support 7 is fitted with stabilizer legs 12 fixed to the connecting plates 10. The section of the studs 8 is of course such that they can enter the channels formed by the bottom rails 6 and the top rails 12. Furthermore, the connection of each stud 8 and 9 to the connecting plate 10 includes a pivot 13 (see FIG. 5) enabling the studs to rotate about the pivot in a plane parallel to the plate 10 so that the support can be removed and replaced with a wall panel (see below).

When the supports 7 have been installed (see FIG. 2) the top rails 12 are placed on the tops of the studs 8 and 9 of the supports 7. One end of the top rail 12A vertically above the bottom rail 6A (see FIG. 3) rests on the support 7 and its other is fixed to the angle-iron 3 fixed to the wall 4 of the sanitation unit S.

The suspended ceiling slats are then installed: light fitting slat 14A, fire detector slat 14B, loudspeaker slat 14C.

The wall panels 15 are then installed, starting from the sanitation unit, by inserting the upper end of a panel into the channel formed by the top rail 12, 12A, moving it to a vertical position, and then lowering it into the bottom rail 6, 6A.

The panels are then screwed at 16 to the top rails 12, 12A. The support 7 can be removed when a sufficiently long run of panels 15 has been installed and fixed to the top rail; the top rail 12, 12A is then well supported because it is fixed to the panels 15, but it should be noted that it does not rest on the tops of the panels 15: there is a clearance between the tops of the panels 15 and the bottom of the channel formed by the top rail, to enable the panels to be removed individually after unscrewing (16) and disengaging the panel.

The support 7 is removed as shown in FIG. 5 by pivoting the studs 8, 9. Installation of the wall panels 15 continues when the support has been removed.

Figure 6:
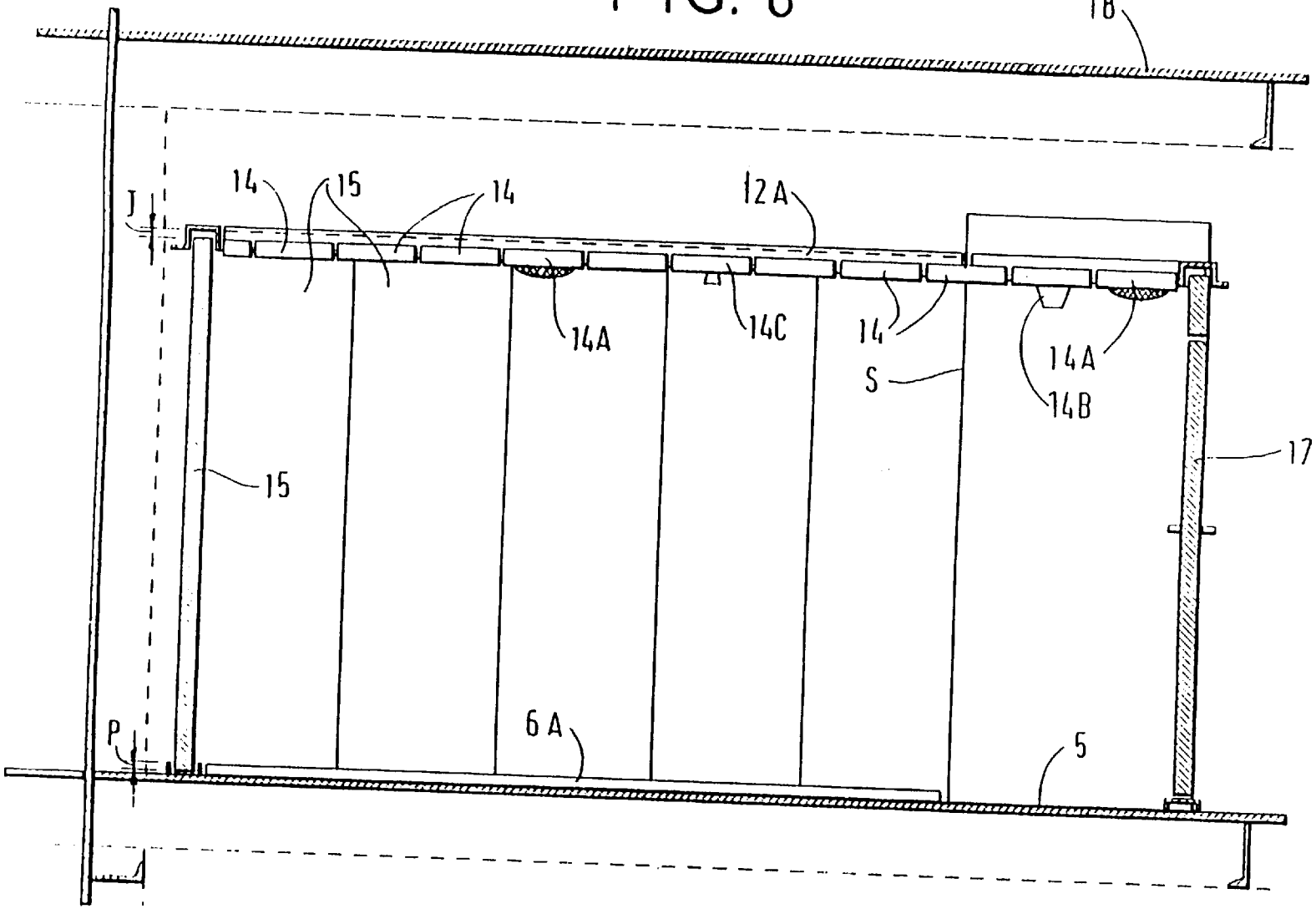
FIG. 6 shows a finished wall with all its wall panels and the ceiling slats installed.

Finally, the other ceiling slats 14 are installed (see FIG. 6).

Note that all the ceiling slats can be installed before the wall panels 15 if the points 16 at which the panels are screwed is lower than the top of the ceiling slats 14.

FIG. 6 shows the cabin door 17.

Because the supports 7 are used, there is no connection between the deck 18 overhead and the top rails 12, 12A, with all the attendant advantages: there is no transmission of noise and the cabins are decoupled from structural strains. Also, the top rails do not rest on the top edges of the wall panels 15, which can therefore be removed individually, provided that the clearance J at the top of the panels 15 is at least equal to the depth P of the channel formed by the bottom rails 6, 6A (see FIG. 6).

What is claimed is:

1. A method of installing wall panels of ships' cabins including a sanitation space having a sanitation unit said method comprising:

installing the sanitation unit, fixing an angle-iron for supporting slats for making up the cabin ceiling to the outside periphery of the sanitation unit, fixing a bottom rail with a U-shaped section to the deck at a location where the wall panels are installed, supporting a first top rail with an inverted U-shaped section which caps an upper edge of said wall panels without resting on the upper edge and which does not have one end in contact with said sanitation unit temporarily at each end by a support positioned in a corresponding bottom rail, supporting a second top rail with an inverted U-shaped section which caps the upper edge of said wall panels without resting on the upper edge and which has one end in contact with said angle-iron of said sanitation unit on only one end, installing said wall panels starting from said sanitation unit, by inserting said wall panels in at least one of said first top rail and said second top rail and allowing them to drop into said bottom rail, screwing said panels to a vertical flange of at least one of said first top rail and said second top rail, and replacing said supports by said wall panels as installation proceeds, the depth of the channel formed by at least one of said first top rail and said second top rail being greater than that formed by said bottom rail.

2. A method according to claim 1, wherein said slats for making up the ceiling are placed on and fixed to a first end and a second end of said first top rail or placed on and fixed to said second top rail at one end and placed on and fixed to said angle-irons fixed to said sanitation unit at an other end.

3. A removable support for use in the installation method according to claim 1, wherein said support comprises:

two parallel simple studs connected to each other by a connecting plate extending over less than the total height of the studs and of length shorter than that of the studs by an amount not less than a depth P of the channel formed by said bottom rail, the section of said studs being such that they can be engaged in at least one of said first top rail and said second top rail and said bottom rail, and wherein the connection of each stud to said connecting plate includes a pivot in a plane parallel to the plate enabling the support to be removed from its location between at least one of said first top rail and said second top rail and said bottom rail and replaced by the wall panels.

* * * * *